US008770416B1

(12) United States Patent
Guida

(10) Patent No.: US 8,770,416 B1
(45) Date of Patent: Jul. 8, 2014

(54) WALL MOUNTABLE ORGANIZER ASSEMBLY

(76) Inventor: Silvia M. Guida, Burlington (CA)

( * ) Notice: Subject to any disclaimer, the term of this patent is extended or adjusted under 35 U.S.C. 154(b) by 54 days.

(21) Appl. No.: 13/543,111

(22) Filed: Jul. 6, 2012

(51) Int. Cl.

| | |
|---|---|
| ***B42F 17/00*** | (2006.01) |
| ***A47F 5/08*** | (2006.01) |
| ***A47B 95/00*** | (2006.01) |
| ***A47B 67/02*** | (2006.01) |
| ***A47F 3/00*** | (2006.01) |

(52) U.S. Cl.
CPC ..... *A47F 5/08* (2013.01); *A47B 95/008* (2013.01); *A47B 67/02* (2013.01); *A47F 3/005* (2013.01); *Y10S 211/01* (2013.01)
USPC ..... 211/10; 211/87.01; 211/DIG. 1

(58) Field of Classification Search
CPC ..... B25H 3/04; B25H 3/06; G09F 5/04; G09F 5/042; B65D 77/006; A47F 7/163; A47F 5/08; A47F 5/10; A47F 3/005; A47F 3/00; A47B 63/00; A47B 95/008; A47B 97/04; A47B 97/08; A47B 67/02; A47B 61/00
USPC ..... 211/10, 87.01, DIG. 1; 312/245, 230, 312/242, 227, 114; 248/466, 489, 497; 40/738, 611.02, 611.03; 206/232, 472, 206/473; 220/476, 477, 480
See application file for complete search history.

(56) References Cited

U.S. PATENT DOCUMENTS

| | | | | |
|---|---|---|---|---|
| 1,222,612 | A | | 4/1917 | Evans |
| 2,038,666 | A | | 4/1936 | Moore |
| 2,179,857 | A | | 11/1939 | Lowenthal |
| 2,275,373 | A | * | 3/1942 | Barrett ..... 312/300 |
| 4,209,212 | A | * | 6/1980 | McGoldrick ..... 312/245 |
| 4,304,447 | A | * | 12/1981 | Ellwood et al. ..... 312/204 |
| 4,324,446 | A | * | 4/1982 | LeSage ..... 312/245 |
| 4,413,736 | A | * | 11/1983 | Nibling ..... 206/566 |
| 4,420,084 | A | * | 12/1983 | Whelan ..... 206/566 |
| 4,423,562 | A | | 1/1984 | Nichols |
| 4,889,237 | A | * | 12/1989 | Brandon ..... 206/534 |
| 5,141,300 | A | * | 8/1992 | Ciesla ..... 312/204 |
| D382,299 | S | | 8/1997 | Silvey |
| 5,758,936 | A | * | 6/1998 | Baughan ..... 312/245 |
| 5,833,330 | A | * | 11/1998 | Kos ..... 312/209 |
| 6,345,456 | B1 | | 2/2002 | Bracken |
| 6,349,494 | B1 | * | 2/2002 | Haggarty-Robbins ..... 40/723 |
| 6,361,130 | B1 | * | 3/2002 | Kardy ..... 312/245 |
| 6,364,126 | B1 | * | 4/2002 | Enriquez ..... 211/13.1 |
| 6,375,018 | B1 | * | 4/2002 | Clement ..... 211/85.2 |
| 6,422,671 | B1 | * | 7/2002 | Lodge et al. ..... 312/245 |
| 6,574,894 | B1 | | 6/2003 | Hamilton |
| 6,616,253 | B1 | * | 9/2003 | Greaux ..... 312/248 |
| 7,008,029 | B1 | * | 3/2006 | Aclin ..... 312/245 |

(Continued)

*Primary Examiner* — Jennifer E Novosad

(57) ABSTRACT

A wall mountable organizer assembly is provided for storing and displaying items in an organized manner including a removable calendar. The assembly includes a back panel configured for mounting on a support surface. A perimeter wall extends around the back panel. The perimeter wall also extends forwardly from the back panel to define a back cavity. A medial panel is selectively positionable in the back cavity. A cover panel is pivotally coupled to the back panel. The cover panel covers the back cavity when the cover panel is in a closed position. The cover panel having a front face and a back face. A peripheral wall extends around the cover panel. The peripheral wall abuts the perimeter wall of the back panel when the cover panel is in the closed position. The peripheral wall forms a frame around the front face of the cover panel.

1 Claim, 5 Drawing Sheets

(56) References Cited

U.S. PATENT DOCUMENTS

| | | | | |
|---|---|---|---|---|
| 7,044,178 | B1 * | 5/2006 | Campbell | 144/285 |
| 7,424,784 | B1 | 9/2008 | Leahy | |
| 7,673,749 | B2 * | 3/2010 | Kosann et al. | 206/449 |
| 8,141,280 | B2 * | 3/2012 | Doss | 40/122 |
| 8,151,980 | B2 * | 4/2012 | DeMartino | 206/6.1 |
| 8,424,982 | B1 * | 4/2013 | Schwartz | 312/227 |
| 2001/0040423 | A1 * | 11/2001 | Sheehan | 312/245 |
| 2002/0000058 | A1 | 1/2002 | Chang | |
| 2003/0117046 | A1 * | 6/2003 | Simon et al. | 312/245 |
| 2003/0218407 | A1 * | 11/2003 | Chen | 312/265.5 |
| 2004/0256335 | A1 * | 12/2004 | Sholem | 211/70.6 |
| 2005/0040741 | A1 * | 2/2005 | Simmons | 312/245 |
| 2008/0169739 | A1 * | 7/2008 | Goldenberg | 312/244 |
| 2008/0203869 | A1 * | 8/2008 | Mallory | 312/245 |
| 2010/0011645 | A1 * | 1/2010 | Milburn-Hall | 40/724 |
| 2010/0206765 | A1 * | 8/2010 | Fonte | 206/534 |

* cited by examiner

WALL MOUNTABLE ORGANIZER ASSEMBLY

BACKGROUND OF THE DISCLOSURE

Field of the Disclosure

The disclosure relates to organizing devices and more particularly pertains to a new organizing device for storing and displaying items in an organized manner including a removable calendar.

SUMMARY OF THE DISCLOSURE

An embodiment of the disclosure meets the needs presented above by generally comprising a back panel configured for mounting on a support surface. A perimeter wall extends around the back panel. The perimeter wall also extends forwardly from the back panel to define a back cavity. A medial panel is selectively positionable in the back cavity. A cover panel is pivotally coupled to the back panel. The cover panel covers the back cavity when the cover panel is in a closed position. The cover panel having a front face and a back face. A peripheral wall extends around the cover panel. The peripheral wall abuts the perimeter wall of the back panel when the cover panel is in the closed position. The peripheral wall forms a frame around the front face of the cover panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
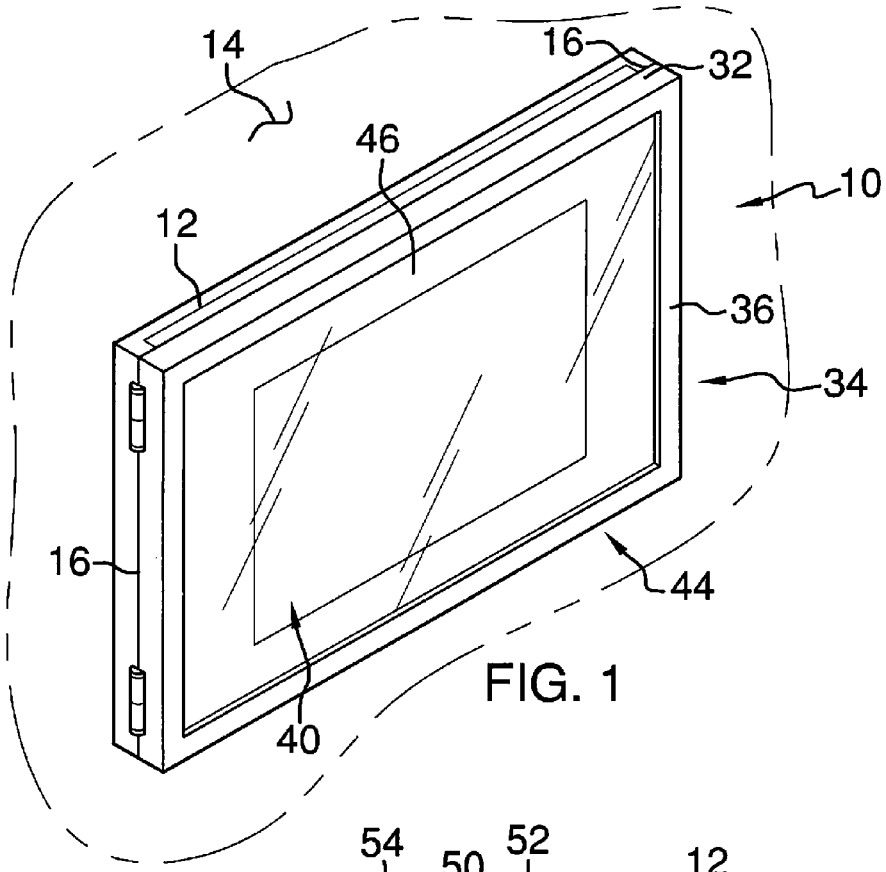
FIG. 1 is a top front side view of a wall mountable organizer assembly according to an embodiment of the disclosure.
Figure 2:
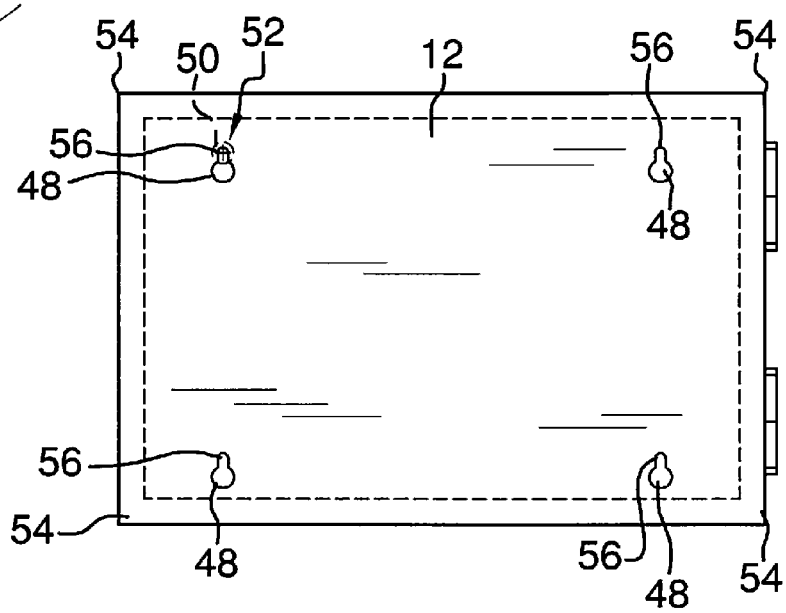
FIG. 2 is a back view of an embodiment of the disclosure.
Figure 3:
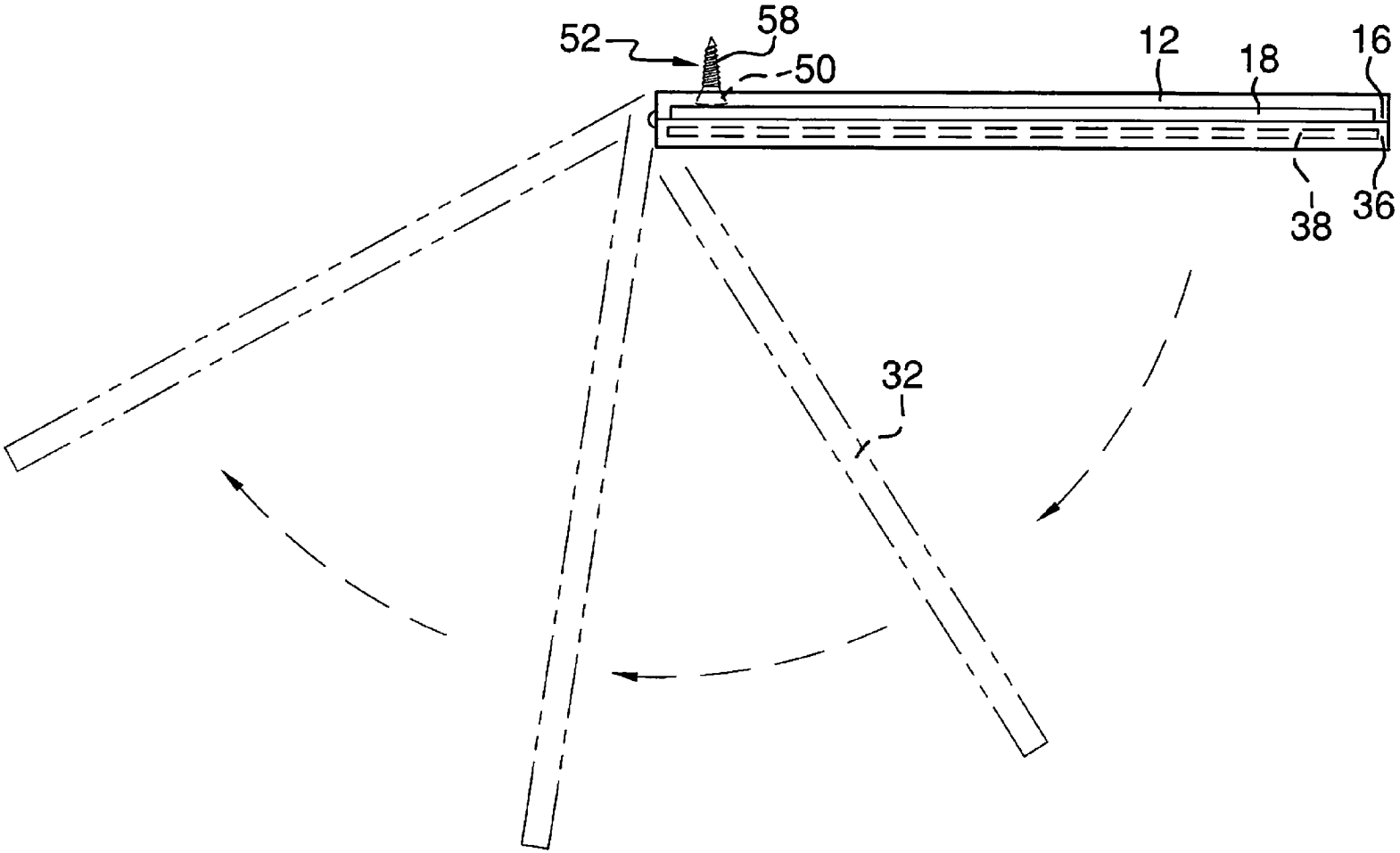
FIG. 3 is a top view of an embodiment of the disclosure.
Figure 4:
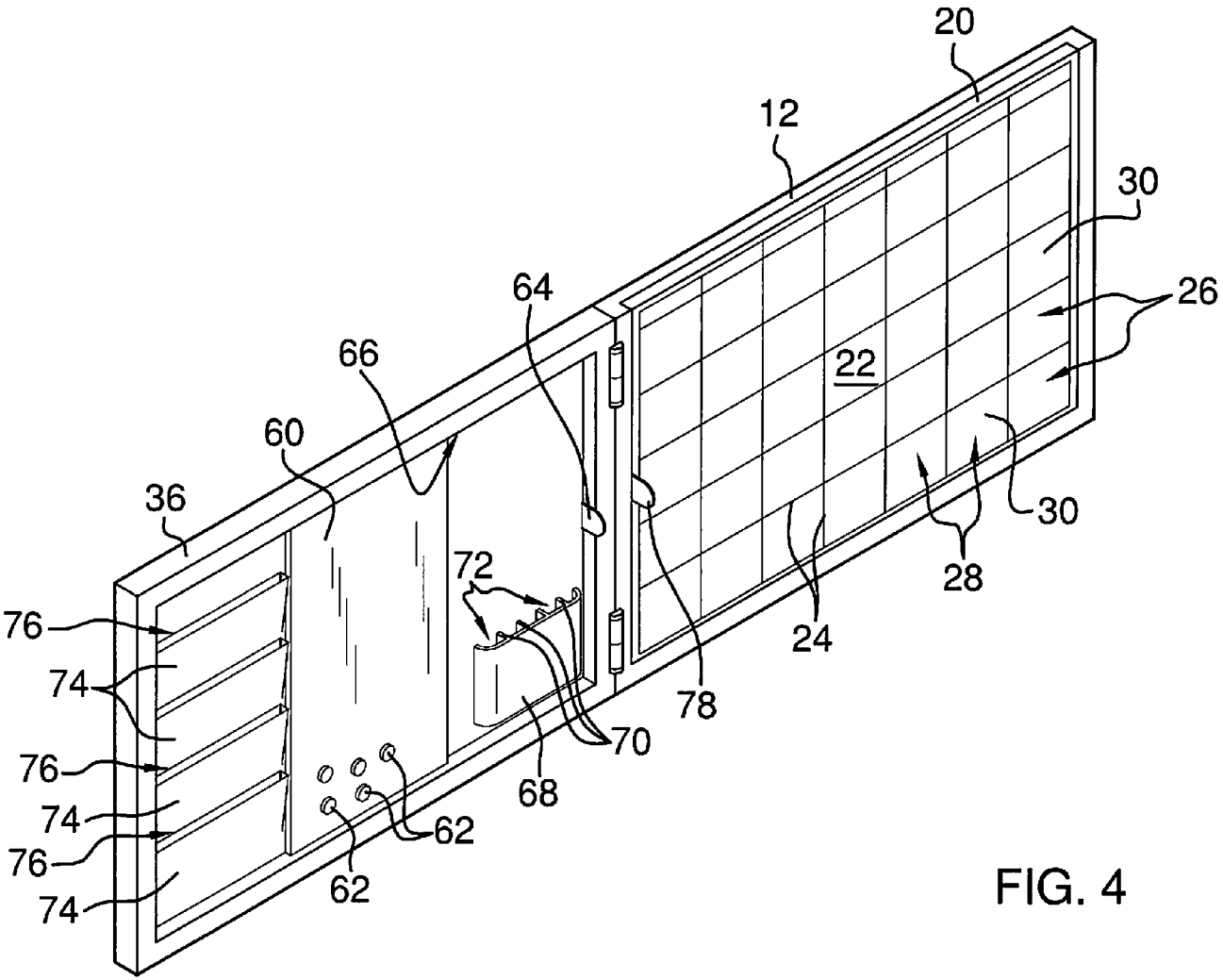
FIG. 4 is a front top side perspective view of an embodiment of the disclosure in an open position.
Figure 5:
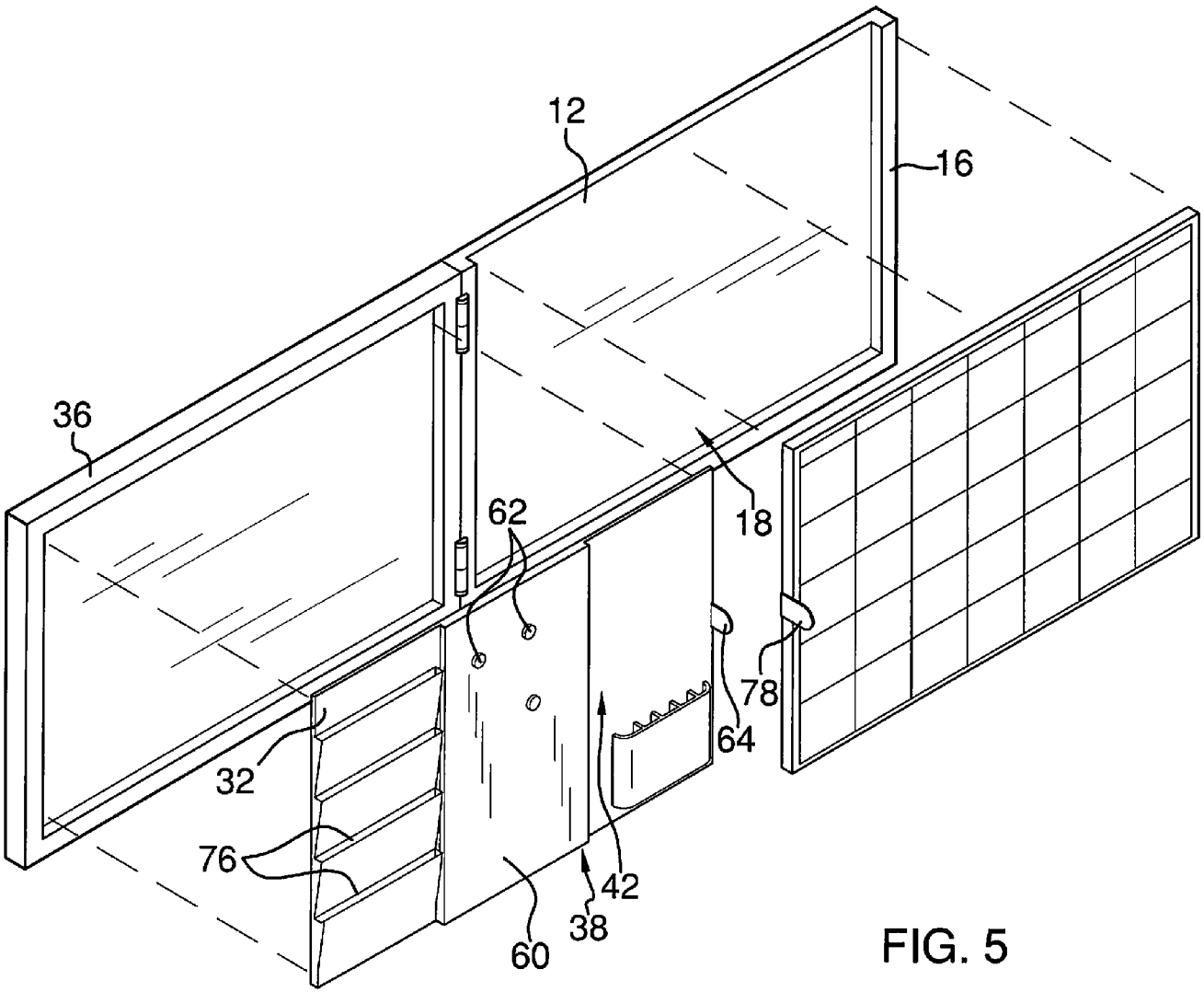
FIG. 5 is a partially exploded top front side perspective view of an embodiment of the disclosure.
Figure 6:
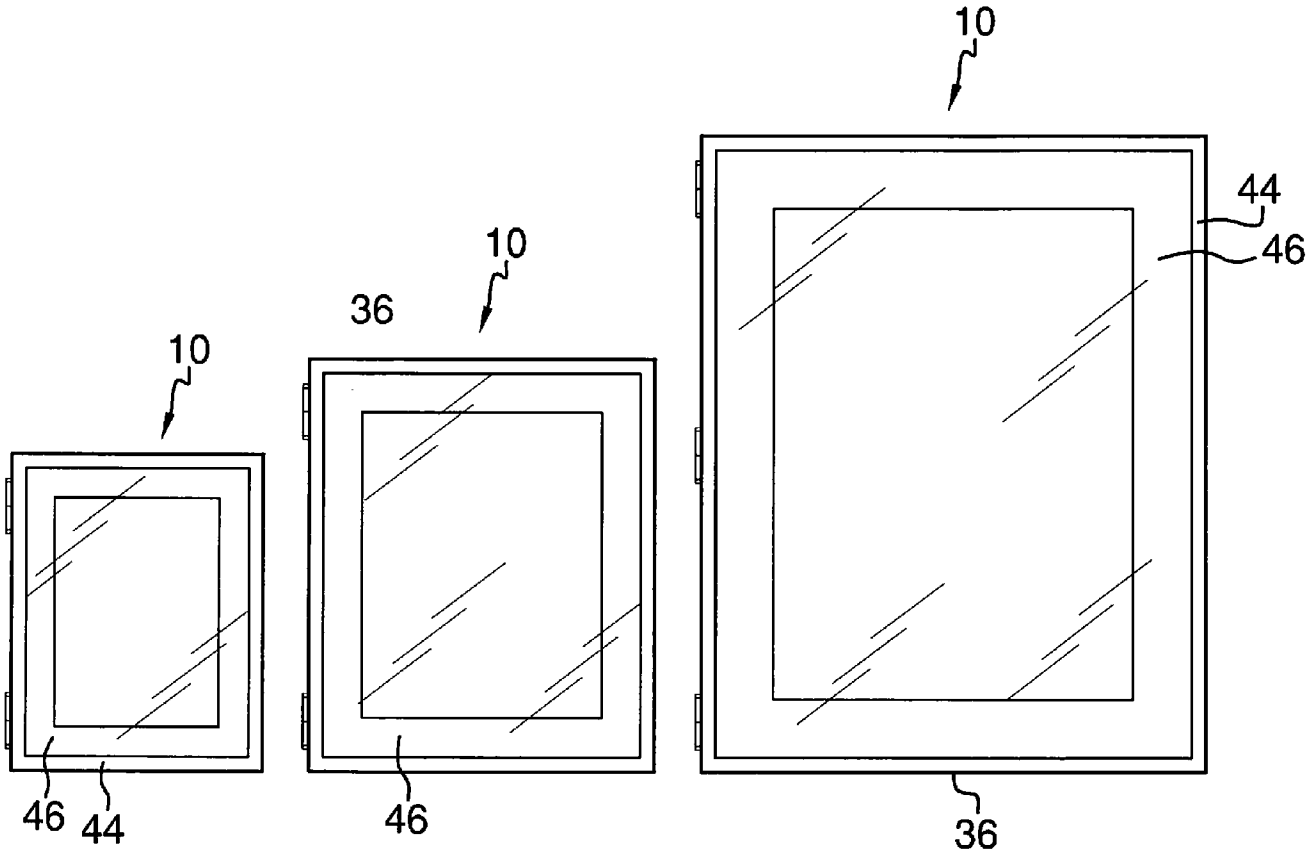
FIG. 6 is a front view of various sizes of embodiments of the disclosure.

With reference now to the drawings, and in particular to FIGS. 1 through 6 thereof, a new organizing device embodying the principles and concepts of an embodiment of the disclosure and generally designated by the reference numeral 10 will be described.

As best illustrated in FIGS. 1 through 6, the wall mountable organizer assembly 10 generally comprises a back panel 12 configured for mounting on a support surface 14 such as a post or wall. A perimeter wall 16 extends around the back panel 12 extending forwardly from the back panel 12 to define a back cavity 18. A medial panel 20 is selectively positionable in the back cavity 18 and may be removed as desired to provide access to the medial panel 20 separate from the back panel 12. The medial panel 20 may be constructed to provide a writing surface 22 for keeping notes. More specifically, the medial panel 20 may have indicia 24 thereon defining rows 26 and columns 28 of spaces 30 whereby the medial panel 20 is configured for use as a calendar. A cover panel 32 is pivotally coupled to the back panel 12 by virtue of being coupled to a peripheral wall 36. The cover panel 32 covers the back cavity 18 when the cover panel 32 is in a closed position 34. The peripheral wall 36 extends around the cover panel 32. The cover panel 32 may be frictionally engaged to the peripheral wall 36 to permit removal of the cover panel 32 as described more fully below. The peripheral wall 36 abuts the perimeter wall 16 of the back panel 12 when the cover panel 32 is in the closed position 34. The peripheral wall 36 extends rearwardly from the cover panel 32 when the cover panel 32 is fully inserted defining a forward cavity 38. The cover panel 32 further has a front face 40 and a back face 42. The peripheral wall 36 may be structured to form a frame 44 around the front face 40 of the cover panel 32. A picture may be coupled to the cover panel 32 against the front face 40 for displaying the picture. A pane of glass or other suitable material may be inserted between the cover panel 32 and the peripheral wall as in a conventional picture frame structure such that the pane of glass is utilized to protect the picture in the frame 44. A border 46 may be provided and similarly coupled to the frame 44 by positioning between the pane of glass and the cover panel 32. The border 46 extends inwardly from the peripheral wall 36 to extend around the picture, offsetting the picture from the peripheral wall 36.

A plurality of holes 48 extend into the back panel 12. Each hole 48 is configured to receive a head 50 of a screw 52 whereby the back panel 12 is configured for coupling to the support surface 14. Each hole 48 may be positioned adjacent to an associated corner 54 of the hack panel 12 for stability when removing the medial panel 20 from the back cavity 18. A plurality of slots 56 are provided with each slot 56 extending from an associated one of the holes 48. Each slot 56 is configured for receiving a shaft 58 of the screw 52 after the head 50 of the screw 52 is inserted through the associated hole 48.

A plurality of items may be provided on the cover panel 32. A magnetic hoard 60 is coupled to the cover panel 32 positioned in the forward cavity 38. A plurality of magnetic holders 62 is selectively couplable to the magnetic board 60 to retain notes, letters and the like to the magnetic board 60. A pencil holder 68 may be coupled to the back face 40 of the cover panel 32 in the forward cavity 38. The pencil holder 68 may be a single unit having a plurality of dividers 70 defining sections 72 each configured for storing a writing implement. A plurality of dividing walls 74 may be coupled to the hack face 40 of the cover panel 32. The dividing walls 74 are positioned in spaced aligned relationship to each other and angled relative to the back face 40 of the cover panel 32 defining a plurality of pockets 76 in the forward cavity 38.

A tab 78 may be coupled to the medial panel 20. The tab 78 extends forwardly out of the back cavity 18 when the medial panel 20 is positioned in the back cavity 18. Thus, the tab 78 is configured to be grasped to facilitate removing the medial panel 20 from the back cavity 18. Similarly, a second tab 64 may be coupled to the cover panel 32 to facilitate removal of the cover panel 32 from the peripheral wail 36.

In use, the back panel 12 is coupled to the support surface 14. The medial panel 20 is positioned in the back cavity and used to record information as desired. The medial panel 20 is removed from the hack cavity 18 as desired to facilitate changing information on the medial panel 20 as desired as desired. Pens, letters, business cards, and the like may all be stored neatly within the forward cavity 38 using the pockets 76, magnetic board 60, and pencil holder 68. A picture may be displayed in the frame 44 which faces outwardly from the support surface 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wall mountable organizing assembly comprising:

a back panel, said back panel being configured for mounting on a support surface;

a perimeter wall extending around said back panel, said perimeter wall extending forwardly from said back panel to define a back cavity;

a medial panel, said medial panel being selectively positionable in said back cavity, said medial panel having indicia whereby said medial panel is configured for use as a calendar;

a cover panel, said cover panel covering said back cavity when said cover panel is in a closed position, said cover panel having a front face and a back face;

a peripheral wall coupled to and extending around said cover panel, said peripheral wall being pivotally coupled to said back panel, said peripheral wall abutting said perimeter wall of said back panel when said cover panel is in said closed position, said peripheral wall extending rearwardly from said cover panel defining a forward cavity, said peripheral wall forming a frame around said front face of said cover panel, said cover panel being selectively removable from said peripheral wall;

a border coupled to said frame, said border extending inwardly from said peripheral wall;

a plurality of holes extending into said back panel, each hole being configured to receive a head of a screw whereby said back panel is configured for coupling to the support surface, each said hole being positioned adjacent to an associated corner of said back panel;

a plurality of slots, each slot extending from an associated one of said holes, each slot being configured for receiving a shaft of the screw after the head of the screw is inserted through the associated hole;

a magnetic board coupled to said cover panel, said magnetic board being positioned in said forward cavity;

a plurality of magnetic holders selectively couplable to said magnetic board;

a pencil holder coupled to said back face of said cover panel, said pencil holder being positioned in said forward cavity;

a plurality of dividing walls coupled to said back face of said cover panel, said dividing walls being positioned in spaced aligned relationship to each other defining a plurality of pockets in said forward cavity;

a tab coupled to said medial panel, said tab extending forwardly out of said back cavity when said medial panel is positioned in said back cavity whereby said tab is configured to be grasped to facilitate removing said medial panel from said back cavity; and a second tab coupled to said cover panel, said second tab extending out of said forward cavity when said cover panel is inserted into said peripheral wall.

* * * * *